United States Patent [19]

Hazelton

[11] Patent Number: 5,074,936

[45] Date of Patent: Dec. 24, 1991

[54] AMORPHOUS MAGNESIUM/ALUMINUM-BASED ALLOYS

[75] Inventor: Lowell E. Hazelton, Sunol, Calif.

[73] Assignee: The Dow Chemical Company, Midland, Mich.

[21] Appl. No.: 517,982

[22] Filed: May 2, 1990

Related U.S. Application Data

[63] Continuation-in-part of Ser. No. 333,478, Apr. 5, 1989.

[51] Int. Cl.[5] ..... C22C 21/06; C22C 23/02

[52] U.S. Cl. ..... 148/403

[58] Field of Search ..... 148/403

[56] References Cited

U.S. PATENT DOCUMENTS 4,595,429 6/1986 Le Caer et al. ..... 148/403

4,710,246 12/1987 Le Caer et al. ..... 148/403

FOREIGN PATENT DOCUMENTS 8908154 9/1989 World Int. Prop. O. .

OTHER PUBLICATIONS

Kabayashi et al., "Microstructural Aspects of Rapidly Solidified Aluminum-Magnesium Alloys", Tran. Jpn. Inst. Met., vol. 28, No. 11, pp. 934–944, Chem. Abs. #108(8):60605j, Nov. 1987.

*Primary Examiner*—R. Dean
*Assistant Examiner*—David Schumaker

[57] ABSTRACT

A substantially amorphous aluminum/magnesium alloy optionally containing up to about ten atom percent calcium. The alloy contains from about 45 to about 75 atom percent aluminum and from about 25 to about 50 atom percent magnesium.

5 Claims, No Drawings

AMORPHOUS MAGNESIUM/ALUMINUM-BASED ALLOYS

CROSS REFERENCE TO RELATED APPLICATION

This is a Continuation-in-Part of co-pending application, Ser. No. 07/333,478, filed Apr. 5, 1989.

BACKGROUND OF THE INVENTION

This invention relates to the field of metal alloys. More particularly, it relates to the field of amorphous aluminum- and magnesium-based alloys.

In the search for engineering materials researchers have targeted magnesium-based alloys as having potentially desirable properties. These desirable properties include exceptionally low density and excellent machinability at relatively low cost. However, magnesium also has properties frequently considered to be undesirable, including poor corrosion resistance, strength (particularly compressive strength), and formability. In view of this, much effort has been directed toward improving conventional casting and wrought alloys containing magnesium. In spite of this, magnesium-based alloys have never seen wide usage for structural applications because of their problems with corrosion resistance and mechanical properties.

In recent years extensive research has also been conducted on amorphous alloys. In general amorphous alloys are considered to be potentially more desirable because they exhibit improvements in various properties over crystalline alloys. These properties often include, for example, tensile strength, hardness, ductility, corrosion resistance, and magnetic properties including hysteresis loss and magnetoelastic effects. Transition metal/metalloid pairs, early transition metal/late transition metal pairs and transition metal/rare earth pairs have been well researched. In addition, some work has been done on amorphous alloys based on simple metals such as magnesium, calcium, strontium, zinc, copper, silver and cadmium. Simple metals as used herein refers to metals having only s or p valence electrons, thus excluding transition metals, rare earths, and actinides. Among these, the amorphous magnesium-based alloys prepared most often have been alloys of magnesium with copper, nickel, zinc, antimony, calcium or bismuth. However, the densities of most of these alloys, except for some of the calcium-containing alloys, are too high to make them of practical interest as a lightweight alloy.

For example, one publication describing magnesium-based amorphous alloys is F. Sommer et al., "Thermodynamic Investigations of Mg-Cu and Mg-Ni Metallic Glasses," *J. de Phys., Colloque C8*, Vol. 41, No. 8 (August 1980), 563–566. This work describes metalloid-free metallic glasses in the Mg-Cu system and the Mg-Ni system. In both of these systems glasses are formed at greater than 50 percent magnesium. F. Sommer et al., in "Formation Conditions and Thermodynamic Stability of Glassy Ternary Alloys," *Proc. 4th Int. Conf. on Rapidly Quenched Metals* (Sendai, 1981), 209–212, discusses ternary alloys based on the binary glass forming Mg-Cu and Mg-Ni systems. In this publication Mg-Cu-Ni, Mg-Cu-Zn and Mg-Ni-Zn ternary systems were investigated and found to form glasses along the entire length of the invariant valleys connecting the binary eutectics, which are surrounded by glass-formation regions. It is also noted that, in ternary systems where only one of the constituent binary systems exhibits easy glass formation, complete glass formation vanishes with very small additions of a third component (e.g., Mg-Cu-Sb, Mg-Ni-Al and Mg-Ni-Ag), or can be found only up to a certain concentration of the third component (e.g., Mg-Cu-Sn, Mg-Cu-Pb, Mg-Cu-Ag, Mg-Ni-Sn and Mg-Ni-Sb).

Alloys in the Mg-Zn system have also been widely investigated, for example, in A. Calka et al., "A Transition-Metal-Free Amorphous Alloy: $Mg_{70}Zn_{30}$," *Scripta Metallurgica*, Vol. 11 (1977), 65–70. This work describes the Mg-Zn system as especially favorable for amorphous metal formation, based on the existence of a deep eutectic. The size difference of the components and their tendency to form complex equilibrium compounds combine to make this a promising system. Complete amorphization in the 68–75 atom percent magnesium range was observed.

Another Mg alloy system investigated is the amorphous Mg-Ca binary system. These alloys are described in, e.g., R. St. Amand et al., "Easy Glass Formation in Simple Metal Alloys: Amorphous Metals Containing Calcium and Strontium," *Scripta Metallurgica, Vol.* 12 (1978) 1021–1026. The alloys studied formed glasses over the range $Ca_{57.5}Mg_{42.5}$ to $Ca_{77.5}Mg_{22.5}$. Although such alloys should be very lightweight, they have in our experience been found to be very prone to oxidation when containing large proportions of calcium.

Another metal of great significance for lightweight structural uses is aluminum, which has a density about 1.5 times that of magnesium. Aluminum is very important commercially, due to its low density, good formability, oxidation resistance and high strength. These properties make aluminum a desirable alloy component for many structural applications. For some of these uses, however, it is desirable to have an even lower density material. In the quest for lower density alloys, aluminum has therefore been combined with lithium. See, e.g., T. H. Sanders et al., "Aluminum-Lithium Alloys: Low Density and High Stiffness," *Metal Progress*, Vol. 113, No. 3 (1978), 32–37. In this combination the few percent of lithium reduces density significantly and increases the modulus of elasticity of the resulting alloy. However, the amount of lithium which can be added is limited, and this thereby limits the amount of density reduction attainable.

Amorphous aluminum alloys have also been prepared. For example, Y. He et al., in "Synthesis and Properties of Metallic Glasses That Contain Aluminum," *Science*, Vol. 241, 1640–1642, disclose the synthesis of metallic glasses containing up to 90 atom percent aluminum. These glasses exhibit unusually high strength. The glasses described are mainly ternary glasses based on an Al-Fe system. Aluminum-based amorphous alloys are also described by a research team at the Institute for Metals Research of Tohoku University in Japan. According to an article, "Extra Strength Claimed for New Aluminum-Based Alloy," in *Metalworking News*, June 6, 1988, p. 26, small amounts of nickel, yttrium, lanthanum and other rare earths are added to produce an alloy that is twice as strong as super-duraluminum.

Attempts to reduce the density of conventional aluminum alloys by alloying aluminum and magnesium have also been envisioned, analogous to the production of aluminum/lithium alloys. However, those skilled in the art expect serious problems in this endeavor, because these two elements have only limited solid solubilities in each other. Incorporating too much of either element into a crystalline alloy with the other results in the formation of excessive amounts of intermetallic compounds, which exhibit very undesirable mechanical properties including brittleness. Nevertheless, despite these problems it is still potentially desirable to alloy the two together because the magnesium has the potential to impart to an alloy a lower density than aluminum, while the aluminum has the potential to offset the poor corrosion resistance, compressive strength and formability of magnesium.

Thus, despite research done on magnesium-based and aluminum-based crystalline and amorphous alloys, there is still a need for improved alloy systems utilizing magnesium and aluminum. Preferably these systems should combine the positive features of magnesium, including its low density and excellent machinability, with the high tensile and compressive strength, ductility, oxidation resistance and corrosion resistance of aluminum. Even more preferably, these systems should also exhibit the positive features of an amorphous alloy, including higher strength and ductility.

SUMMARY OF THE INVENTION

Accordingly, the present invention provides a family of substantially amorphous alloys based on a binary magnesium/aluminum system, further potentially comprising a third element, calcium. The invention is, in one embodiment, a substantially amorphous alloy represented by the formula: $Al_xMg_yCa_zI_a$ wherein I is impurities; $x+y+z+a=100$; $45 \leqq x \leqq 75$ atom percent; $20 \leqq y \leqq 50$ atom percent: $0 \leqq z \leqq 10$ atom percent; and $0 \leqq a \leqq 5$ atom percent.

DESCRIPTION OF THE PREFERRED EMBODIMENTS

The present invention is essentially a family of alloys based on magnesium and aluminum. The alloys comprise at least aluminum and magnesium, and in one embodiment also include calcium. Impurities derived from processing techniques in particular may also be present in small amounts.

The alloys of the present invention are substantially amorphous. As used herein "substantially" means that the alloys are more than 50 percent by weight amorphous. It is preferred that the alloys are more than 75 percent by weight amorphous; more preferred that they are more than 90 percent by weight amorphous; and most preferred that they are more than 95 percent by weight amorphous. The remainder, if any, can be crystalline or microcrystalline. The amorphous nature of these alloys allows for the maintenance of many of the desirable properties of each constituent, and circumvents the problem of brittleness and poor mechanical properties in general encountered when magnesium and aluminum are alloyed together in a crystalline alloy.

The substantially amorphous alloys of the present invention contain from about 45 to about 75 atom percent aluminum and from about 20 to about 50 atom percent magnesium, more preferably from about 25 to about 50 atom percent magnesium. They also may contain calcium in an amount from about 0 to about 10 atom percent. Impurities may be present in an amount of less than or equal to about 5 atom percent. In one embodiment the substantially amorphous alloys preferably contain from about 50 to about 65 atom percent aluminum, from about 30 to about 45 atom percent magnesium, and from about 3 to about 6 atom percent calcium. It is preferred that the alloys have glass transition temperatures below their respective crystallization temperatures. The glass transition temperatures are preferably substantially below the crystallization temperatures. This difference allows for processing of the alloys to form articles without crystallization. It is also preferred that the amorphous alloys of the present invention exhibit a higher reduced glass transition temperature ($T_{rg}$) than most other known amorphous alloys. The $T_{rg}$ is the ratio of the glass transition temperature ($T_g$) to the liquidus temperature ($T_l$).

To produce the alloys of the present invention it is preferred to mechanically alloy the elements together without large amounts of lubricants. More preferably no lubricants are used. The elements are preferably initially in powder form. For the mechanical alloying high-energy ball mills are preferred. Milling the constituent powders for a sufficient time produces a substantially amorphous alloy powder, i.e., the extensive, repeated fracturing and welding of the powders produces a substantially amorphous material mixed on an atomic or near-atomic level. In order to prevent the oxidation of fracture surfaces, the milling operation is preferably conducted in an atmosphere of argon, nitrogen or another inert gas. Temperatures are preferably less than the glass transition temperature ($T_g$) of the alloy being produced, and the milling time is sufficient to produce a substantially amorphous alloy. This time is more preferably from about 1 to about 6 hours. Other effective means, known to those skilled in the art, of producing the compositions of the present invention can also be used, for example, rapid solidification methods.

The following examples are given to more fully illustrate the present invention. They are not intended to be, and should not be construed as being, limitative of the scope of the invention.

EXAMPLE 1

The alloy $Al_{57}Mg_{38}Ca_5$ is prepared by mechanically alloying a total of 2.5 g of the constituents in a high-energy ball mill. The starting powders are prepared by filing them from solid ingots to reduce oxidation. These powders are then loaded into vials under argon and hermetically sealed, and the vials are loaded into a SPEX* Model 8000 mixer/mill (*SPEX is a trademark of Spex Industries, Inc.). Milling is done for 4 hours and the temperature is about 60° C. The result is an alloy that is more than 95 percent by weight amorphous.

X-ray diffraction analysis shows only crystalline peaks due to a small amount of iron contamination. Differential scanning calorimetry analysis shows a glass transition point ($T_g$) of 218° C. at a heating rate of 10° C./min. The lowest peak temperature ($T_x$) for the crystallization reaction is 290° C. at a heating rate of 10° C./min.

EXAMPLE 2

Two samples of the same composition as in Example 1 are prepared, each totaling 0.55 g. For one sample the same preparation conditions as in Example 1 are used, with milling at 50° C. For the other sample milling is done at −150° C. X-ray diffraction analysis shows that the sample milled at 50° C. has a higher percentage of crystallinity than does the sample milled at −150° C. The sample milled at −150° C. is more than about 95 percent amorphous, and the sample milled at 50° C. is more than about 80 percent amorphous.

EXAMPLE 3

The alloy $Al_{60}Mg_{40}$ is prepared by mechanically alloying a total of 0.55 g of the constituents as described in Example 1. X-ray diffraction analysis shows that the resultant alloy is more than about 50 percent amorphous.

EXAMPLE 4

Alloys conforming to the following formulas are prepared as described in Example 1 and shown by X-ray diffraction analysis to be substantially amorphous as defined herein.

$Al_{64}Mg_{31}Ca_5$
$Al_{60}Mg_{35}Ca_5$
$Al_{57}Mg_{40}Ca_3$
$Al_{55.5}Mg_{37}Ca_{7.5}$
$Al_{50}Mg_{45}Ca_5$
$Al_{65}Mg_{28}Ca_7$
$Al_{70}Mg_{25}Ca_5$
$Al_{75}Mg_{20}Ca_5$
$Al_{45}Mg_{50}Ca_5$

What is claimed is:

1. A substantially amorphous alloy represented by the formula:

$$Al_xMg_yCa_zI_a$$

wherein I is impurities:
$x+y+z+a=100$:
$45 \leqq x \leqq 75$ atom percent:
$25 \leqq y \leqq 50$ atom percent:
$0 \leqq z \leqq 10$ atom percent: and
$0 \leqq a \leqq 5$ atom percent.

2. A substantially amorphous alloy represented by the formula:

$$Al_xMg_yCa_zI_a$$

wherein I is impurities;

$$x+y++z+a=100;$$

$50 \leqq x \leqq 65$ atom percent; $30 \leqq y \leqq 45$ atom percent; $3 \leqq z \leqq 6$ atom percent; and $0 \leqq a \leqq 5$ atom percent.

3. The composition of claim 1 wherein $z=0$.

4. A method of preparing a substantially amorphous alloy represented by the formula:

$$Al_xMg_yCa_zI_a$$

wherein I is impurities:
$x+y+z+a=100$:
$45 \leqq x \leqq 75$ atom percent:
$25 \leqq y \leqq 50$ atom percent:
$0 \leqq z \leqq 10$ atom percent: and
$0 \leqq a \leqq 5$ atom percent;
said method comprising mechanically alloying Al, Mg and, optionally, Ca together.

5. A method of preparing a substantially amorphous alloy represented by the formula:

$$Al_xMg_yCa_zI_a$$

wherein I is impurities;

$$x+y+z+a=100;$$

$50 \leqq x \leqq 65$ atom percent; $30 \leqq y \leqq 45$ atom percent; $3 \leqq z \leqq 6$ atom percent; and $0 \leqq a \leqq 5$ atom percent;
said method comprising mechanically alloying Al, Mg and Ca together.

* * * * *